US009877133B2

(12) United States Patent
Katagiri

(10) Patent No.: US 9,877,133 B2
(45) Date of Patent: Jan. 23, 2018

(54) SOUND COLLECTION AND REPRODUCTION SYSTEM, SOUND COLLECTION AND REPRODUCTION APPARATUS, SOUND COLLECTION AND REPRODUCTION METHOD, SOUND COLLECTION AND REPRODUCTION PROGRAM, SOUND COLLECTION SYSTEM, AND REPRODUCTION SYSTEM

(71) Applicant: Oki Electric Industry Co., Ltd., Tokyo (JP)

(72) Inventor: Kazuhiro Katagiri, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 120 days.

(21) Appl. No.: 14/727,496

(22) Filed: Jun. 1, 2015

(65) Prior Publication Data

US 2016/0021478 A1 Jan. 21, 2016

(30) Foreign Application Priority Data

Jul. 18, 2014 (JP) ..... 2014-148188

(51) Int. Cl.
*H04R 5/00* (2006.01)
*H04S 7/00* (2006.01)
(Continued)

(52) U.S. Cl.
CPC ..... *H04S 7/30* (2013.01); *H04R 5/027* (2013.01); *H04R 29/005* (2013.01); *H04S 7/303* (2013.01);
(Continued)

(58) Field of Classification Search
CPC . H04R 5/027; H04R 5/00; H04R 5/02; H04R 2201/401; H04R 2201/40;
(Continued)

(56) References Cited

U.S. PATENT DOCUMENTS 8,983,089 B1 * 3/2015 Chu ..... H04R 3/005 381/58
2010/0208903 A1 * 8/2010 Heigl ..... G08B 13/1672 381/58
2012/0114152 A1 * 5/2012 Nguyen ..... G06T 7/0065 381/303

FOREIGN PATENT DOCUMENTS

JP 2014-072661 A 4/2014

OTHER PUBLICATIONS

Masato Nonaka et al., "Office communication system utilizing multiple videos/sounds/sensors".

(Continued)

*Primary Examiner* — Md S Elahee
*Assistant Examiner* — Sabrina Diaz
(74) *Attorney, Agent, or Firm* — Rabin & Berdo, P.C.

(57) ABSTRACT

The sound collection and reproduction system reproduces comprise: a microphone array selection unit which selects a microphone arrays; an area sound collection unit which collects sounds of all areas by using the microphone arrays; an area sound selection unit which selects an area sound of an area corresponding to a specified listening position, and area sounds of surrounding areas of this area corresponding to a listening direction, in accordance with a sound reproduction environment; an area volume adjustment unit which adjusts a volume of each area sound unit in accordance with a distance from the specified listening position; and a stereophonic sound processing unit which performs a stereophonic sound process, for each area sound to which volume adjustment has been performed by the area volume adjustment unit, by using a transfer function corresponding to a sound reproduction environment.

8 Claims, 5 Drawing Sheets

(51) Int. Cl.
*H04R 5/027* (2006.01)
*H04R 29/00* (2006.01)

(52) U.S. Cl.
CPC .... *H04R 2201/401* (2013.01); *H04R 2430/23* (2013.01); *H04S 2400/13* (2013.01)

(58) Field of Classification Search
CPC ..... H04R 2201/403; H04R 2201/405; H04R 29/005; H04R 29/004; H04R 29/007; H04R 2400/01; H04R 2430/21; H04R 2430/23; H04S 7/30; H04S 7/303; H04S 2400/01
USPC ..... 381/26, 300, 303, 122, 91, 92
See application file for complete search history.

(56) References Cited

OTHER PUBLICATIONS

Kenta Niwa et al., "Selective listening point-type acoustic field reproduction based on blind source separation".

* cited by examiner

SOUND COLLECTION AND REPRODUCTION SYSTEM, SOUND COLLECTION AND REPRODUCTION APPARATUS, SOUND COLLECTION AND REPRODUCTION METHOD, SOUND COLLECTION AND REPRODUCTION PROGRAM, SOUND COLLECTION SYSTEM, AND REPRODUCTION SYSTEM

CROSS REFERENCE TO RELATED APPLICATION(S)

This application is based upon and claims benefit of priority from Japanese Patent Application No. 2014-148188, filed on Jul. 18, 2014, the entire contents of which are incorporated herein by reference.

BACKGROUND

The present disclosure relates to a sound collection and reproduction system, a sound collection and reproduction apparatus, a sound collection and reproduction method, a sound collection and reproduction program, a sound collection system, and a reproduction system. The present disclosure can be applied, for example, in the case where sounds ("sounds" includes audio, sounds or the like) existing within a plurality of areas are respectively collected, and thereafter the sounds of each area are processed and mixed, and stereophonically reproduced.

Along with the development of ICT, the demand has increased for technology which uses video and sound information of a remote location to provide a sensation as if being at the remote location.

In Non-Patent Literature 1, a telework system is proposed which can smoothly take communication with a remote location, by connecting between a plurality of offices existing in separated locations, and mutually transferring video, sounds and various types of sensor information. In this system, a plurality of cameras and a plurality of microphones are arranged in locations within the offices, and video and sound information obtained from the cameras and microphones are transmitted to the other separated offices. A user can freely switch cameras of a remote location, sounds collected by microphones arranged close to a camera can be reproduced each time a camera is switched, and the condition of the remote location can be known in real-time.

Further, in Non-Patent Literature 2, a system is proposed in which a plurality of cameras and microphones are arranged in an array shape within a room, and a user can freely select a viewing and listening position and appreciate content such as a video and audio recorded orchestra performance within this room. In this system, sounds recorded by using microphone arrays are separated for each sound source by an Independent Component Analysis (hereinafter, ICA). While it is usually necessary for sound source separation by an ICA to solve the permutation problem of having the component of each separated sound source replaced and output for each frequency component, in this system, collection and separation is performed for each sound source existing near a position, by grouping the frequency components on the basis of space similarities. While there is the possibility that a plurality of sound sources will be mixed in the sounds after being separated, the influence for finally reproducing all of the sound sources will be small. By estimating position information of the separated sound sources, and performing reproduction by adding a stereophonic sound effect to the sound sources in accordance with a viewing angle of selected cameras, sounds with a sense of presence can be heard by a user.

Non-Patent Literature 1: Masato Nonaka, "An office communication system utilizing multiple videos/sounds/sensors", Human Interface Society research report collection, Vol. 13, No. 10, 2011.

Non-Patent Literature 2: Kenta Niwa, "Encoding of large microphone array signals for selective listening point audio representation based on blind source separation", The Institute of Electronics technical research report, EA, Application sounds, 107 (532), 2008.

SUMMARY

However, even if the systems disclosed in Non-Patent Literature 1 and Non-Patent Literature 2 are used, there is an insufficiency for allowing a user to experience the present condition of various locations in a remote location with an abundant presence.

If the system disclosed in Non-Patent Literature 1 is used, a user can view the inside of an office which is at a remote location from every direction in real-time, and can also listen to sounds of this location. However, with regards to sounds, since sounds simply collected by microphones are only reproduced as they are, all of the sounds existing in the surroundings (audio and sounds) will be mixed, and there will be a lack of a sense of presence as there is no sense of direction.

Further, if the system disclosed in Non-Patent Literature 2 is used, sounds of a remote location with a sense of presence can be heard by a user, by processing and reproducing separated sound sources in a stereophonic sound process. However, in order to separate the sound sources, it may be necessary to perform many calculations such as an estimation of an ICA and virtual sound source components, and a further estimation of position information, and so it will be difficult to perform sound collection and reproduction processes simultaneously in real-time. Further, since the output will change due to settings of the sound sources actually existing, the virtual sound source number and the grouping number, it will be difficult to obtain a stable performance under all conditions.

Accordingly, a sound collection and reproduction system, a sound collection and reproduction apparatus, a sound collection and reproduction method, a sound collection and reproduction program, a sound collection system, and a reproduction system have been sought after in which the present condition of various locations in a remote location can be experienced with an abundant presence.

The sound collection and reproduction system according to first embodiment of the present invention reproduces a stereophonic sound by collecting area sounds of all areas divided within a space by using a plurality of microphone arrays arranged in the space. The sound collection and reproduction system may comprise: (1) a microphone array selection unit which selects the microphone arrays for sound collection of each area within the space; (2) an area sound collection unit which collects sounds of all areas by using the microphone arrays for each area selected by the microphone array selection unit; (3) an area sound selection unit which selects an area sound of an area corresponding to a specified listening position, and area sounds of surrounding areas of this area corresponding to a listening direction, from among area sounds of all the areas to which sound collection has been performed by the area sound collection unit, in accordance with a sound reproduction environment; (4) an area volume adjustment unit which adjusts a volume of each area sound selected by the area sound selection unit in accordance with a distance from the specified listening position; and (5) a stereophonic sound processing unit which performs a stereophonic sound process, for each area sound to which volume adjustment has been performed by the area volume adjustment unit, by using a transfer function corresponding to a sound reproduction environment.

The sound collection and reproduction system according to second embodiment of the present invention reproduces a stereophonic sound by collecting area sounds of all areas divided within by a space by using a plurality of microphone arrays arranged in the space. The sound collection and reproduction system may comprise: (1) a microphone array selection unit which selects the microphone arrays for sound collection of each area within the space; (2) an area sound collection unit which collects sounds of all areas by using the microphone arrays for each area selected by the microphone array selection unit; (3) an area sound selection unit which selects an area sound of an area corresponding to a specified listening position, and area sounds of surrounding areas of this area corresponding to a listening direction, from among area sounds of all the areas to which sound collection has been performed by the area sound collection unit, in accordance with a sound reproduction environment; (4) an area volume adjustment unit which adjusts a volume of each area sound selected by the area sound selection unit in accordance with a distance from the specified listening position; and (5) a stereophonic sound processing unit which performs a stereophonic sound process, for each area sound to which volume adjustment has been performed by the area volume adjustment unit, by using a transfer function corresponding to a sound reproduction environment.

The sound collection and reproduction method according to third embodiment of the present invention reproduces a stereophonic sound by collecting area sounds of all areas divided within a space by using a plurality of microphone arrays arranged in the space. The sound collection and reproduction method may comprise: (1) selecting, by a microphone array selection unit, the microphone arrays for sound collection of each area within the space; (2) collecting by an area sound collection unit, sounds of all areas by using the microphone arrays for each area selected by the microphone array selection unit; (3) selecting, by an area sound selection unit, an area sound of an area corresponding to a specified listening position, and area sounds of surrounding areas of this area corresponding to a listening direction, from among area sounds of all the areas to which sound collection has been performed by the area sound collection unit, in accordance with a sound reproduction environment; (4) adjusting, by an area volume adjustment unit, a volume of each area sound selected by the area sound selection unit in accordance with a distance from the specified listening position; and (5) performing, by a stereophonic sound processing unit, a stereophonic sound process, for each area sound to which volume adjustment has been performed by the area volume adjustment unit, by using a transfer function corresponding to a sound reproduction environment.

The sound collection and reproduction program according to forth embodiment of the present invention reproduces a stereophonic sound by collecting area sounds of all areas divided within a space by using a plurality of microphone arrays arranged in the space. The sound collection and reproduction program may cause a computer to function as: (1) a microphone array selection unit which selects the microphone arrays for sound collection of each area within the space; (2) an area sound collection unit which collects sounds of all areas by using the microphone arrays for each area selected by the microphone array selection unit; (3) an area sound selection unit which selects an area sound of an area corresponding to a specified listening position, and area sounds of surrounding areas of this area corresponding to a listening direction, from among area sounds of all the areas to which sound collection has been performed by the area sound collection unit, in accordance with a sound reproduction environment; (4) an area volume adjustment unit which adjusts a volume of each area sound selected by the area sound selection unit in accordance with a distance from the specified listening position; and (5) a stereophonic sound processing unit which performs a stereophonic sound process, for each area sound to which volume adjustment has been performed by the area volume adjustment unit, by using a transfer function corresponding to a sound reproduction environment.

The sound collection system according to fifth embodiment of the present invention collects area sounds of all areas divided within a space by using a plurality of microphone arrays arranged in the space. The sound collection system may comprise: (1) a microphone array selection unit which selects the microphone arrays for sound collection of each area within the space; and (2) an area sound collection unit which collects sounds of all areas by using the microphone arrays for each area selected by the microphone array selection unit.

The reproduction system according to seventh embodiment of the present invention reproduces a stereophonic sound by collecting area sounds of all areas divided within a space by using a plurality of microphone arrays arranged in the space. The reproduction system may comprise: (1) an area sound selection unit which selects an area sound of an area corresponding to a specified listening position, and area sounds of surrounding areas of this area corresponding to a listening direction, from among area sounds of all the areas, in accordance with a sound reproduction environment; (2) an area volume adjustment unit which adjusts a volume of each area sound selected by the area sound selection unit in accordance with a distance from the specified listening position; and (3) a stereophonic sound processing unit which performs a stereophonic sound process, for each area sound to which volume adjustment has been performed by the area volume adjustment unit, by using a transfer function corresponding to a sound reproduction environment.

According to embodiments of the present disclosure, it is possible to allow a user to experience the present condition of various locations in a remote location with an abundant presence.

DETAILED DESCRIPTION OF THE EMBODIMENT(S)

Figure 1:
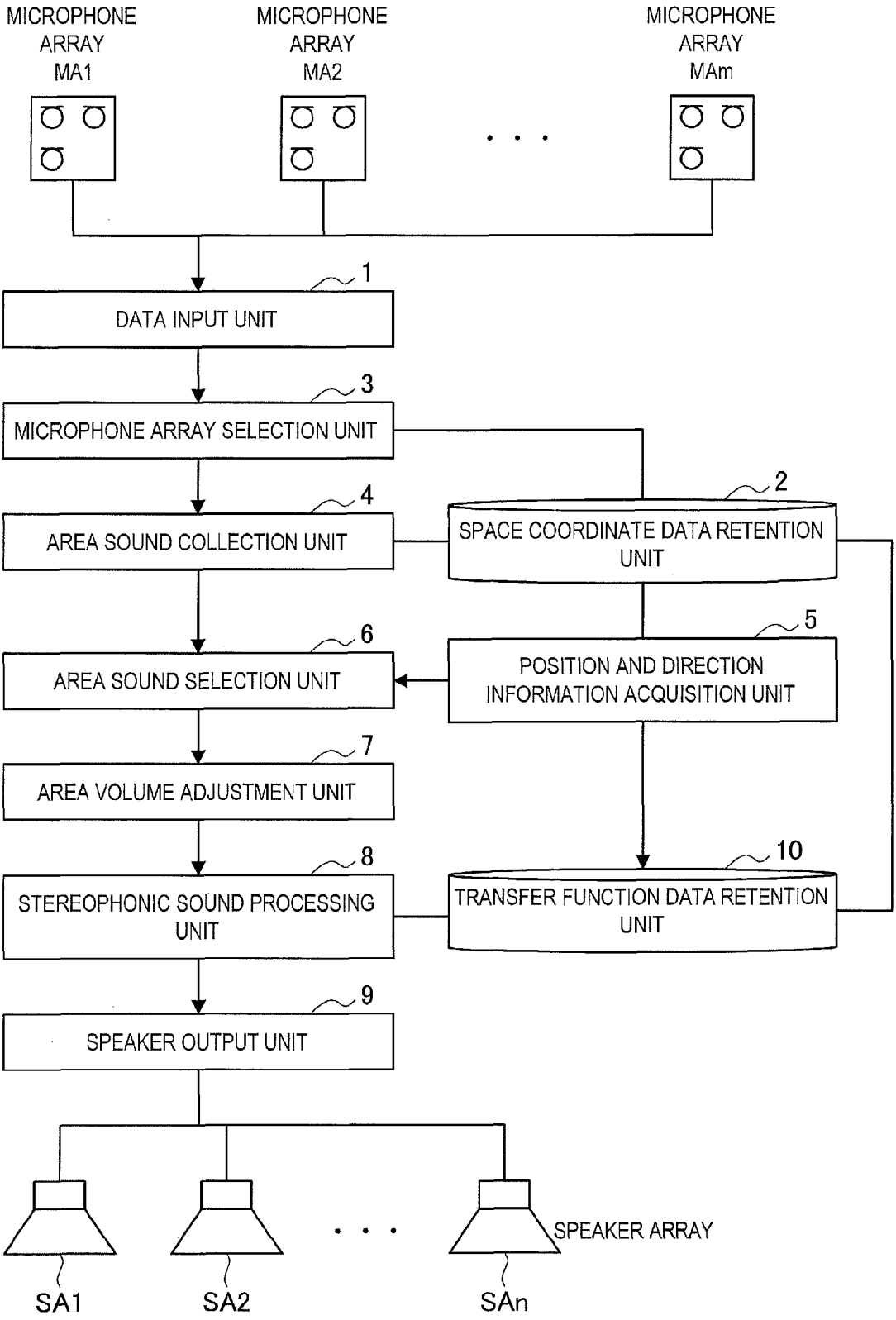
FIG. 1 is a block diagram which shows a configuration of a sound collection and reproduction apparatus according to an embodiment of the present disclosure.

Hereinafter, referring to the appended drawings, preferred embodiments of the present invention will be described in detail. It should be noted that, in this specification and the appended drawings, structural elements that have substantially the same function and structure are denoted with the same reference numerals, and repeated explanation thereof is omitted.

(A) Main Embodiment

Hereinafter, an embodiment of the sound collection and reproduction system, sound collection and reproduction apparatus, sound collection and reproduction method, sound collection and reproduction program, sound collection system, and reproduction system according to an embodiment of the present disclosure will be described in detail with reference to the figures.

(A-1) Description of the Technical Idea of Embodiments

First, the technical idea of embodiments according to the present disclosure will be described. The present inventors have proposed a sound collection system which divides a space of a remote location into a plurality of areas, and collects sounds for each respective area, by using microphone arrays arranged in the space of the remote location (Patent Literature 1: JP 2013-179886A, specification and figures). The sound collection and reproduction system according to this embodiment uses a sound collection technique proposed by the present inventors. Since this sound collection technique can change the extent of the areas which collect sounds by changing the arrangement of the microphone arrays, the space of the remote location can be divided in accordance with the environment of the remote location. Further, this sound collection technique can simultaneously collect area sounds of all of the divided areas.

Accordingly, the sound collection and reproduction system according to an embodiment simultaneously collects area sounds of all of the areas in a space of a remote location, selects area sounds in accordance with a sound reproduction environment of a user, in accordance with a viewing and listening position and direction of the remote location selected by the user, and applies and outputs a stereophonic sound process to the selected area sounds.

(A-2) Configuration of the Embodiment

Configuration diagram 1 of an embodiment is a block diagram which shows a configuration of the sound collection and reproduction apparatus (sound collection and reproduction system) according to an embodiment. In FIG. 1, the sound collection and reproduction apparatus 100 according to an embodiment has microphone arrays MA1 to MAm (m is an integer), a data input unit 1, a space coordinate data retention unit 2, a microphone array selection unit 3, an area sound collection unit 4, a position and direction information acquisition unit 5, an area sound selection unit 6, an area volume adjustment unit 7, a stereophonic sound processing unit 8, a speaker output unit 9, a transfer function data retention unit 10, and speaker arrays SA1 to SAn (n is an integer).

The sound collection and reproduction system 100 according to an embodiment may be constructed by having the portion shown in FIG. 1 which excludes the microphone arrays MA1 to MAm and the speaker arrays SA1 to SAn connect various types of circuits by hardware, or may be constructed so as to implement corresponding functions by having a generic apparatus or unit having a CPU, ROM, RAM or the like execute prescribe programs, and can be functionally represented by FIG. 1, in the case where either construction method is adopted.

Further, the sound collection and reproduction apparatus 100 may be a sound collection and reproduction system capable of transmitting information between a remote location and a location at which a user is viewing and listening, for example, a sound collection portion of sounds (including audio, sounds) by the microphone arrays MA1 to MAm may be constructed in the remote location, and a portion which reproduces sounds in accordance with a sound reproduction environment of the user side by selecting area sounds may be constructed in the viewing and listening location. In this case, the remote location and the viewing and listening location of the user side may include a communication unit (not illustrated) for performing information transmission between the remote location and the viewing and listening location of the user side.

The microphone arrays MA1 to MAm are arranged so as to be able to collect sounds (including audio, sounds) from sound sources existing in all of the plurality of divided areas of a space of the remote location. The microphone arrays MA1 to MAm are respectively constituted from two or more microphones per one microphone array, and collect sound signals acquired by each of the microphones. Each of the microphone arrays MA1 to MAm are connected to the data input unit 1, and the microphone arrays MA1 to MAm respectively provide collected sound signals to the data input unit 1.

The data input unit 1 converts the sound signals from the microphone arrays MA1 to MAm into digital signals from analog signals, and outputs the converted signals to the microphone array selection unit 3.

The space coordinate data retention unit 2 retains position information of the (center of) areas, position information of each of the microphone arrays MA1 to MAm, distance information of the microphones constituting each of the microphone arrays MA1 to MAm or the like.

The microphone array selection unit 3 determines a combination of the microphone arrays MA1 to MAm to be used for collecting sounds of each area based on the position information of the areas and the position information of the microphone arrays MA1 to MAm retained in the space coordinate data retention unit 2. Further, in the case where the microphone arrays MA1 to MAm are constituted from 3 or more microphones, the microphone array selection unit 3 selects the microphones for forming directivity.

Figure 4:
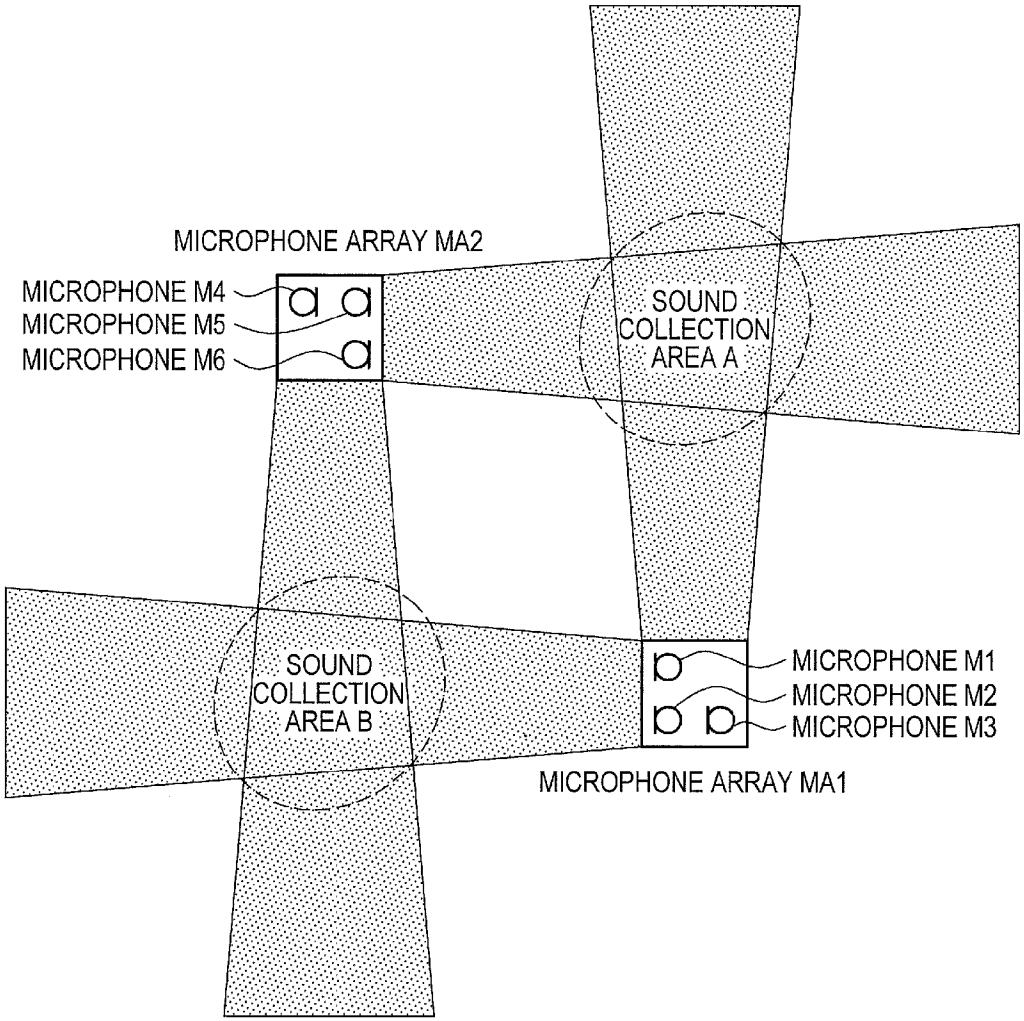
FIG. 4 is an explanatory diagram which describes a condition in which two 3-channel microphone arrays are used to collect sounds from two sound collection areas according to an embodiment of the present disclosure.

Here, an example of a selection method of the microphones which form directivity of each of the microphone arrays by the microphone array selection unit 3 will be described. FIG. 4 describes an example of a selection method of the microphones which form directivity by the microphone array selection unit 3 according to an embodiment.

For example, the microphone array MA1 shown in FIG. 4 has microphones M1, M2 and M3 which are three omni-directional microphones on a same plane. The microphones M1, M2 and M3 are arranged at the vertexes of a right-angled triangle. The distance between the microphones M1 and M2, and the distance between the microphones M2 and M3, are set to be the same. Further, the microphone array MA2 also has a configuration similar to that of the microphone array MA1, and has three microphones M4, M5 and M6.

For example, in FIG. 4, in order to collect sounds from a sound source existing in a sound collection area A, the microphone array selection unit 3 selects the microphones M2 and M3 of the microphone array MA1, and the microphones M5 and M6 of the microphone array MA2. In this way, the directivity of the microphone array MA1 and the directivity of the microphone array MA2 can be formed in the direction of the sound collection area A. Further, when sounds are to be collected from a sound source existing in a sound collection area B, the microphone array selection unit 3 changes the combination of the microphones of each of the microphone arrays MA1 and MA2, and selects the microphones M1 and M2 of the microphone array MA1, and the microphones M4 and M5 of the microphone array MA2. In this way, the directivity of each of the microphone arrays MA1 and MA2 can be formed in the direction of the sound collection area B.

The area sound collection unit 4 collects area sounds of all of the areas, for each combination of microphone arrays selected by the microphone array selection unit 3.

Figure 2:
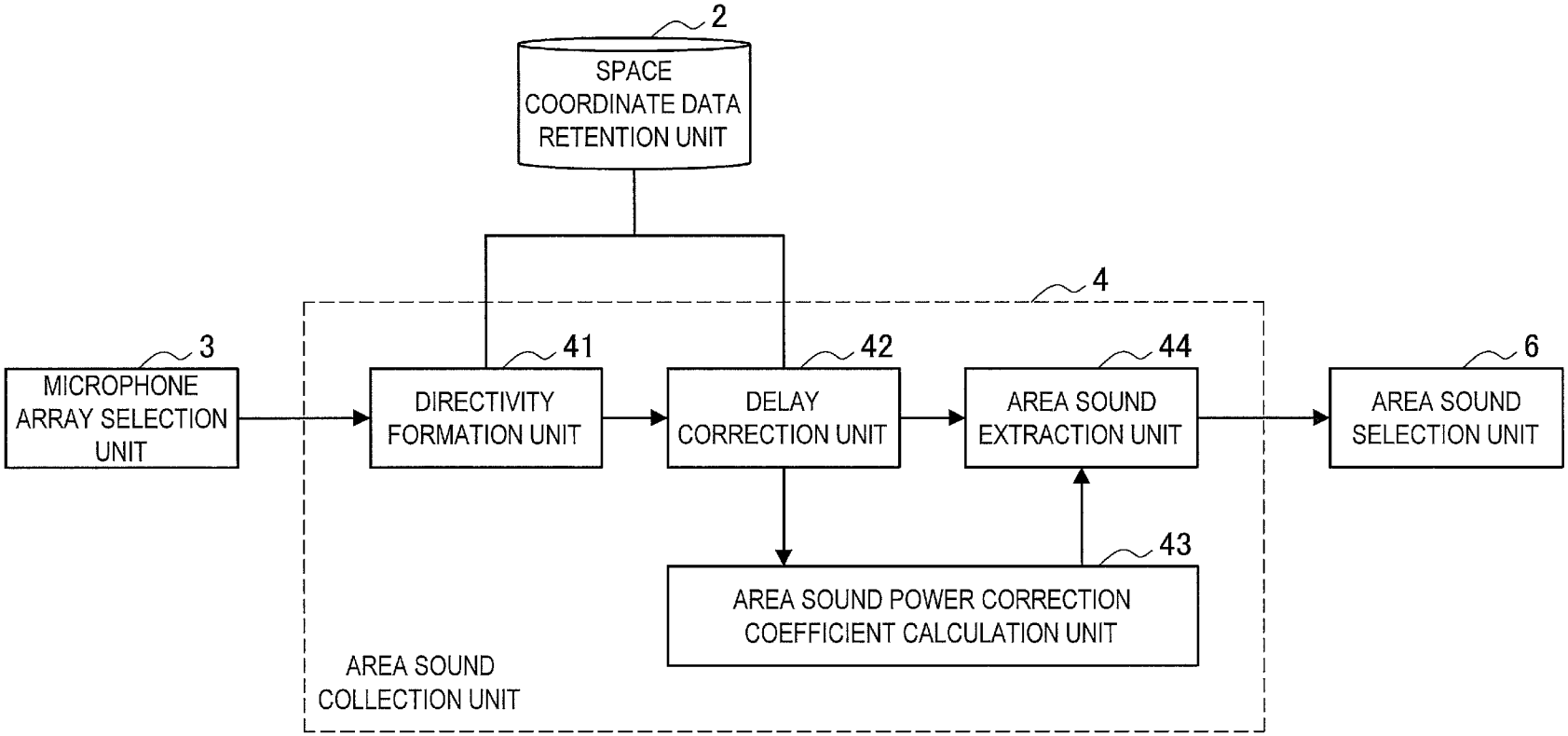
FIG. 2 is a block diagram which shows an internal configuration of an area sound collection unit according to an embodiment of the present disclosure.

FIG. 2 is a block diagram which shows an internal configuration of the area sound collection unit 4 according to this embodiment. As shown in FIG. 2, the area sound collection unit 4 has a directivity forming unit 41, a delay correction unit 42, an area sound power correction coefficient calculation unit 43, and an area sound extraction unit 44.

The directivity forming unit 41 forms a directivity beam towards the sound collection area direction by a beam former (hereinafter, called a BF) in each of the microphone arrays MA1 to MAm. Here, the beam former (BF) can use various types of techniques, such as an addition-type delay sum method or a subtraction-type spectral subtraction method (hereinafter, called an SS). Further, the directivity forming unit 41 changes the intensity of directivity, in accordance with the range of the sound collection area to be targeted.

The delay correction unit 42 calculates a propagation delay time generated by a difference in the distance between all of the respective areas and all of the microphone arrays used for sound collection of each of the areas, and corrects the propagation delay time of all of the microphone arrays. Specifically, the delay correction unit 42 acquires position information of an area from the space coordinate data retention unit 2, and position information of all of the microphone arrays MA1 to MAm used for sound collection of this area, and from this area, calculates a difference (propagation delay time) with the arrival time of area sounds to all of the microphone arrays MA1 to MAm used for sound collection of this area. Then, the delay correction unit 42 corrects a delay by adding the propagation delay time to output signals after the beam former from all of the microphone arrays, so that the area sounds simultaneously arrive at all of the microphone arrays, based on the microphone array arranged at a position furthest from this area. Further, the delay correction unit 42 performs, for all of the areas, a delay correction for the beam former output signals from all of the microphone arrays used for sound collection of respective areas.

The area sound power correction coefficient calculation unit 43 calculates a power correction coefficient for making the power of area sounds included in each of the beam former output signals from each of the microphone arrays used for respective sound collection of all of the areas the same. Here, in order to obtain a power correction coefficient, for example, the area sound power correction coefficient calculation unit 43 calculates a ratio of the amplitude spectrum for each frequency between each of the beam former output signals. Next, the area sound power correction coefficient calculation unit 43 calculates a most-frequent value or a central value from the obtained ratio of the amplitude spectrum for each frequency, and sets this value to a power correction coefficient.

The area sound extraction unit 44 extracts, for all of the areas, noise existing in the sound collection area direction, by spectrally subtracting each of the corrected beam former output data by the power correction coefficient corrected by the area sound power correction coefficient calculation unit 43. In addition, the area sound extraction unit 44 extracts area sounds, by spectrally subtracting the extracted noise from each of the beam former outputs. The area sounds of each of the areas extracted by the area sound extraction unit 44 are output to the area sound selection unit 6 as an output of the area sound collection unit 4.

The position and direction information acquisition unit 5 acquires a position (specified listening position) and direction (listening direction) desired by a user, by referring to the space coordinate data retention unit 2. For example, in the case where a user specifies an intended area or switches the intended area by using a GUI or the like, based on a video of a remote location projected at the viewing and listening location of the user, it switches the camera projecting the specified position, in accordance with this user instruction. In this case, the position and direction information acquisition unit 5 sets the position of the specified area to the position of the intended area, and acquires the direction which projects the intended area from the position of the camera.

The area sound selection unit 6 selects the area sounds to be used in sound reproduction, based on the position information and direction information acquired by the position and direction information acquisition unit 5. Here, the area sound selection unit 6 first sets the area sound nearest to the position specified by the user as a standard (that is, a central sound source). The area sound selection unit 6 sets the area sounds of each of the areas in front, behind, to the left and to the right of the intended area including the central sound source, and additionally the area sounds of each of the areas located in directions diagonal to the intended area (diagonally right in front, diagonally left in front, diagonally right behind, diagonally left behind), as sound sources, in accordance with the direction information. Further, the area sound selection unit 6 selects the area sounds to be used in sound reproduction, in accordance with the sound reproduction environment of the user side.

The area volume adjustment unit 7 adjusts the volume of the area sounds selected by the area sound selection unit 6 in accordance with the position (central position of the intended area) and the direction information specified by the user, in accordance with the distance from the central position of the intended area. The adjustment method of the volume may reduce the volume of an area sound as the area increases in distance from the central position of the intended area, or may make the volume of the area sound of the intended area which is the central sound source the highest, and reduce the volume of the area sounds of the surrounding areas of this. More specifically, for example, a prescribed value a (0<a<1) may be multiplied by the volume of the area sounds of the surrounding areas and adjusted, or only a prescribed value may be subtracted, for example, from the volume of the area sounds of the surrounding areas, so that the volume of the area sounds of the surrounding areas is reduced with respect to the volume of the area sound of the intended area.

The stereophonic sound processing unit 8 stereophonically sound processes each of the area sounds, in accordance with the environment of a user. The stereophonic sound processing unit 8 can arbitrarily apply various types of stereophonic sound processes, in accordance with the sound reproduction environment of the user side. That is, the stereophonic sound process applied by the stereophonic sound processing unit 8 is not particularly limited.

For example, in the case where the user uses headphones and earphones, the stereophonic sound processing unit 8 convolutes a head-related transfer function (HRTF) corresponding to each direction from the viewing and listening position retained by the transfer function data retention unit 10, for the area sounds selected by the area sound selection unit 6, and creates a binaural sound source. Further, for example, in the case of using stereo speakers, the stereophonic sound processing unit 8 converts the binaural sound source into a trans-aural sound source, by a crosstalk canceller designed using an indoor transfer function between the user and the speakers retained by the transfer function data retention unit 10. In the case of using an additional third or more speakers, the stereophonic sound processing unit 8 does not perform processing, or combines with the trans-aural sound source, if the position of the speaker is the same as the position of the area sound, and creates a number of new sound sources the same as that of the speakers.

The speaker output unit 9 outputs sound source data applied by the stereophonic sound process in the stereophonic sound processing unit 8 to each corresponding speaker.

The transfer function data retention unit 10 retains a transfer function of the user side for applying the stereophonic sound process. The transfer function data retention unit 10 retains, for example, a Head-Related Transfer Function (HRTF) corresponding to each direction, an indoor transfer function between the user and the speakers or the like. Further, the transfer function data retention unit 10 may be able to retain, for example, data of an indoor transfer function which has been learnt in accordance with an environment change within a room.

The speaker arrays SA1 to SAn are speakers which are a sound reproduction system of the user side. The speaker arrays SA1 to SAn are capable of stereophonic sound reproduction, and can be set, for example, as earphones, stereo speakers, three or more speakers or the like. In this embodiment, in order to reproduce stereophonic sound, a case will be illustrated in which the speaker arrays SA1 to SAn are two or more speakers, for example, and are arranged so as to be in front of the user or to surround the user.

(A-3) Operation of the Embodiment

The operations of the sound collection and reproduction apparatus 100 according to an embodiment will be described in detail with reference to the figures.

Here, a case will be illustrated in which an embodiment of the present disclosure is applied to a remote system which a user views or listens to video or audio of a space of a remote location. The space of the remote location is divided into a plurality of spaces (in this embodiment, a case will be illustrated in which it is divided into 9, for example), and a plurality of cameras and a plurality of microphone arrays MA1 to MAm are arranged, so that it is possible to collect video of each of the plurality of divided areas and to collect sounds of the sound sources existing in each of the areas.

The microphone arrays MA1 to MAm are arranged so as to be able to collect sounds from all of the plurality of divided areas of the space of the remote location. One microphone array is constituted from two or more microphones, and collects sound signals by each of the microphones.

The sound signals collected by each of the microphones constituting each of the microphone arrays MA1 to MAm are provided to the data input unit 1. In the data input unit 1, the sound signals from each of the microphones of each of the microphone arrays MA1 to MAm are converted into digital signals from analog signals.

In the microphone array selection unit 3, position information of each of the microphone arrays MA1 to MAm retained in the space coordinate data retention unit 2, and position information of each of the areas, are acquired, and a combination of the microphone arrays to be used for collecting sounds of each of the areas is determined. In addition, in the microphone array selection unit 3, microphones for forming directivity to each of the area directions are selected, together with the selection of the combination of microphone arrays to be used for collecting sounds of each of the areas.

In the area sound collection unit 4, sound collection is performed for all of the areas, for each combination of the microphone arrays MA1 to MAm to be used for collecting sounds of each of the areas selected by the microphone array selection unit 3.

Information related to the microphones for forming directivity in each of the area directions is provided to the directivity forming unit 41 of the area sound collection unit 4, with the combination of microphone arrays for collecting sounds of each of the areas selected by the microphone array selection unit 3.

In the directivity forming unit 41, position information (distances) of the microphones of each of the microphone arrays MA1 to MAm for forming directivity in each of the area directions is acquired from the space coordinate data retention unit 2. Then, the directivity forming unit 41 forms, for all of the respective areas, a directivity beam towards the sound collection area direction, by a beam former (BF) for output (digital signals) from the microphones of each of the microphone arrays MA1 to MAm. That is, the directivity forming unit 41 forms a directivity beam for each combination of the microphone arrays MA1 to MAm to be used for collecting sounds of each area of all of the areas of the remote location.

Further, the directivity forming unit 41 may change the intensity of directivity, in accordance with the range of the sound collection area to be targeted. For example, the directivity forming unit 41 may loosen the intensity of directivity at the time when the range of the sound collection area to be targeted is wider than a prescribed value, or may inversely strengthen the intensity of directivity in the case where the range of the sound collection area is narrower than a prescribed value.

The forming method of the directivity beam to each area by the directivity forming unit 41 can widely apply various types of methods. For example, the directivity forming unit 41 can apply the method disclosed in Patent Literature 1 (JP 2013-179886A). For example, noise may be extracted by using an output from all 3 directivity microphones arranged at the vertexes of a right-angled triangle on a same plane, which constitute the microphone arrays MA1 to MAm, and a directivity beam sharp in only an intended direction may be formed, by spectrally reducing this noise from an input signal.

In the delay correction unit 42, position information of each of the microphone arrays MA1 to MAm, and position information of each of the areas, are acquired from the space coordinate data retention unit 2, and a difference (propagation delay time) with the arrival time of area sounds arriving at each of the microphone arrays MA1 to MAm is calculated. Then, the microphone array MA1 to Mam arranged at the nearest position from the position information of the sound collection areas is set as a standard, and the propagation delay time is added to beam former output signals from each of the microphone arrays from the directivity forming unit 41, so that the area sounds simultaneously arrive at all of the microphone arrays MA1 to MAm.

In the area sound power correction coefficient calculation unit 43, a power correction coefficient is calculated for making the power of area sounds included in each of the beam former output signals respectively the same.

First, in order to obtain a power correction coefficient, the area sound power correction coefficient calculation unit 43 obtains a ratio of the amplitude spectrum for each frequency between each of the beam former output signals. At this time, in the case where beam forming is performed in a time domain in the directivity forming unit 41, the area sound power correction coefficient calculation unit 43 converts this into a frequency domain.

Next, in accordance with Equation (1), the area sound power correction coefficient calculation unit 43 calculates a most-frequent value from the obtained ratio of the amplitude spectrum for each frequency, and sets this value to an area sound power correction coefficient. Further, as another method, in accordance with Equation (2), the area sound power correction coefficient calculation unit 43 may calculate a central value from the obtained ratio of the amplitude spectrum for each frequency, and may set this value to an area sound power correction coefficient.

$$\alpha_{ij}(n) = \text{mode}\left(\frac{X_{jk}(n)}{X_{ik}(n)}\right) \quad k = 1, 2, \ldots, N \tag{1}$$

$$\alpha_{ij}(n) = \text{median}\left(\frac{X_{jk}(n)}{X_{ik}(n)}\right) \quad k = 1, 2, \ldots, N \tag{2}$$

Here, $X_{ik}(n)$ and $X_{jk}(n)$ are output data of the beam formers of microphone arrays i and j selected by the microphone array selection unit 3, K is the frequency, N is the total number of frequency bins, and $\alpha_{ij}(n)$ is the power correction coefficient for the beam former output data.

In the area sound extraction unit 44, each of the beam former output signals are corrected by using the power correction coefficient calculated by the area sound power correction coefficient calculation unit 43. Then, noise existing in the sound collection area direction is extracted by spectrally subtracting each of the beam former output data after correction. In addition, the area sound extraction unit 44 extracts an area sound of an intended area by spectrally subtracting the extracted noise from each of the beam former output data.

In order to extract noise $N_{ij}(n)$ existing in the sound collection area direction viewed from the microphone array i, the multiplication of the power correction coefficient $\alpha_{ij}$ by the beam former output $X_j(n)$ of the microphone array j is spectrally subtracted from the beam former output $X_i(n)$ of the microphone array i, such as shown in Equation (3). Afterwards, in accordance with Equation (4), area sounds are extracted by spectrally subtracting noise from each of the beam former outputs. $\gamma_{ij}(n)$ is a coefficient for changing the intensity at the time of spectral subtraction.

$$N_{ij}(n)=X_i(n)-\alpha_{ij}(n)\cdot X_j(n) \tag{3}$$

$$Y_{ij}(n)=X_i(n)-\gamma_{ij}(n)\cdot N_{ij}(n) \tag{4}$$

Equation (3) is an equation in which the area sound extraction unit 44 extracts a noise component $N_{ij}(n)$ existing in the sound collection area direction viewed from the microphone array i. The area sound extraction unit 44 spectrally subtracts the multiplication of the power correction coefficient $\alpha_{ij}(n)$ by the beam former output data $X_j(n)$ of the microphone array j from the beam former output data $X_i(n)$ of the microphone array i. That is, it is intended to obtain a noise component, by subtracting the beam former output Xi(n) and the beam former output Xj(n), upon performing a power correction between the beam former output Xi(n) of the microphone array i and the beam former output Xj(n) of the microphone array j selected for sound collection from an intended area to be targeted.

Equation (4) is an equation in which the area sound extraction unit 44 extracts an area sound, by using the obtained noise component $N_{ij}(n)$. The area sound extraction unit 44 spectrally subtracts the multiplication of the coefficient $\gamma_{ij}(n)$ for an intensity change at the time of spectral subtraction by the obtained noise component $N_{ij}(n)$ from the beam former output data $X_i(n)$ of the microphone array i. That is, it is intended to obtain an area sound of an intended area by subtracting the noise component obtained by Equation (3) from the beam former $X_i(n)$ of the microphone array i. Note that, in Equation (4), while an area sound viewed from the microphone array i is obtained, an area sound viewed from the microphone array j may also be obtained.

In the position and direction information acquisition unit 5, the position and direction of an intended area desired by a user are acquired, by referring to the space coordinate data retention unit 2. For example, from a camera position of a video presently viewed by a user, a position at which the camera is performing focus or the like, the position and direction information acquisition unit 5 refers to the space coordinate data retention unit 2, and acquires the position and direction of an intended area to be viewed and listened to by the user. The position and direction of this case may be capable of being acquired by the user, for example, through a GUI of a remote system or the like.

In the area sound selection unit 6, area sounds to be used for reproduction are selected, in accordance with the sound reproduction environment, by using the position information and direction information of the intended area acquired by the position and direction information acquisition unit 5.

Figure 3A:
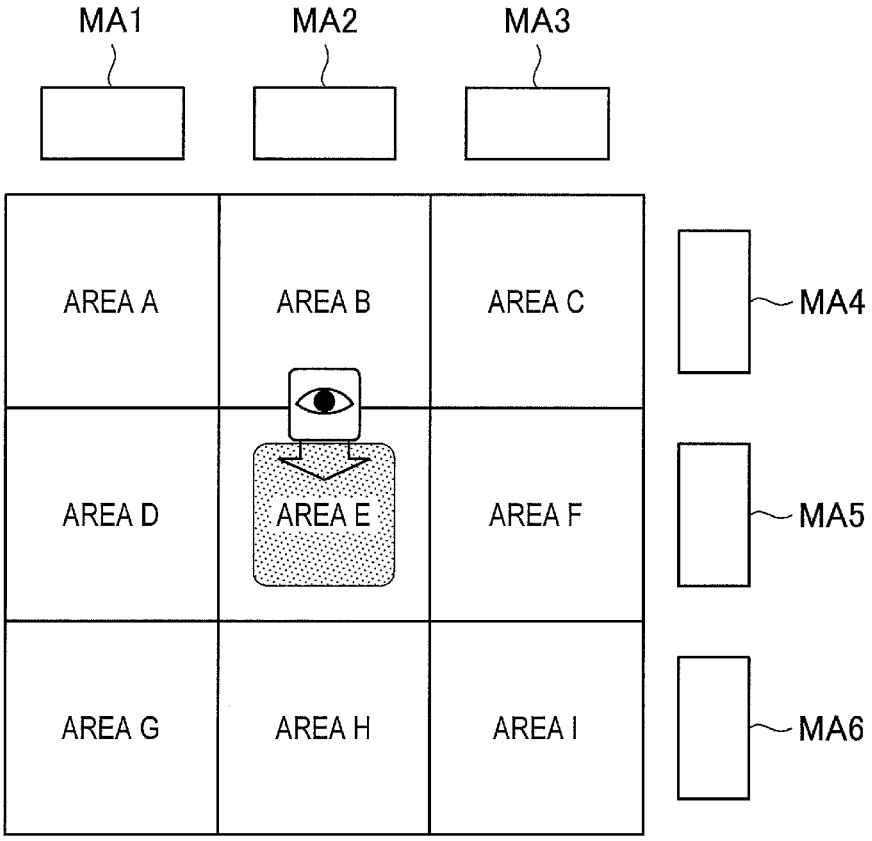
FIG. 3A is a first schematic diagram which shows selecting and reproducing area sounds collected by dividing a space of a remote location into 9 areas, in accordance with an instruction position of a user and a sound reproduction environment, according to an embodiment of the present disclosure.

First, the area sound selection unit 6 sets, for example, an area sound of the area nearest to the viewing and listening position of the user as a central sound source. For example, when "area E" of FIG. 3A is set to the viewing and listening position, the area sound of "area E" will be set as a central sound source.

Figure 3B:
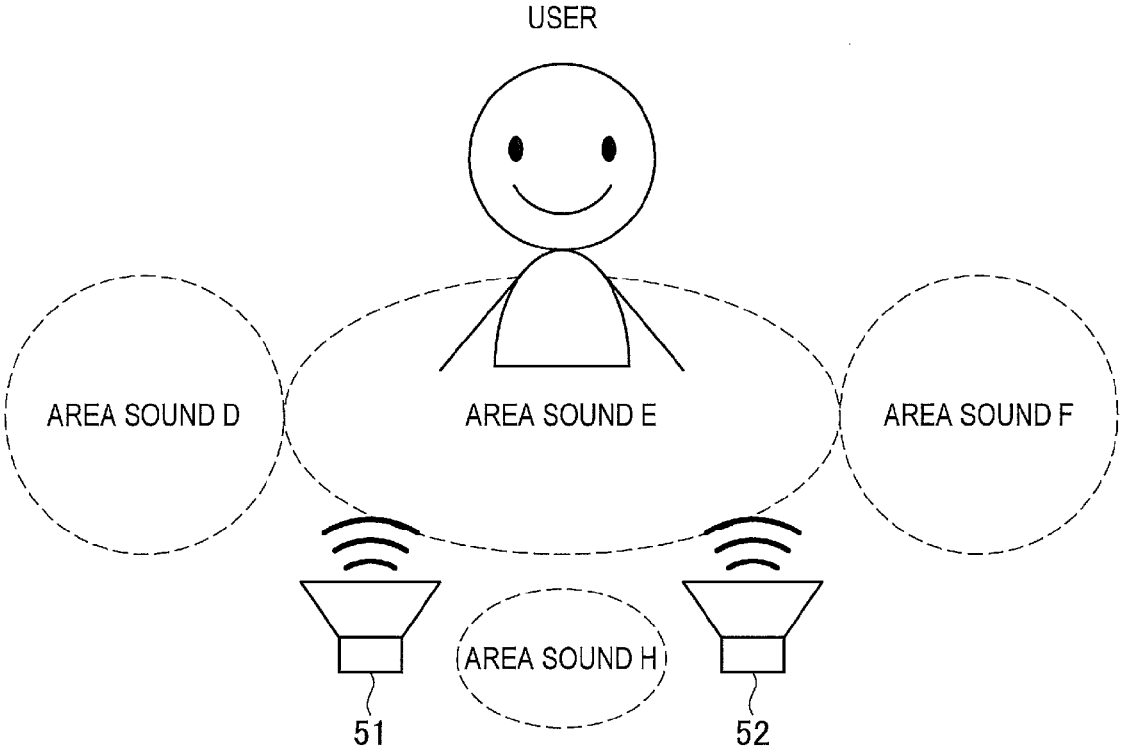
FIG. 3B is a second schematic diagram which shows selecting and reproducing area sounds collected by dividing a space of a remote location into 9 areas, in accordance with an instruction position of a user and a sound reproduction environment, according to an embodiment of the present disclosure.

The area sound selection unit 6 sets the area sounds of the front, rear, left and right areas of the area of the central sound source, that is, the area sound of "area H" to a "front sound source", the area sound of "area B" to a "rear sound source", the area sound of "area F" to a "left sound source" and the area sound of "area D" to a "right sound source", from a direction the same as the direction projected by the camera (for example, in the example of FIG. 3, the direction of area E from area B). In addition, the area sound selection unit 6 may set the area sound of "area I" to a "diagonally left-front sound source", the area sound of "area G" to a "diagonally right-front sound source", the area sound of "area C" to a "diagonally left-rear sound source", and the area sound of "area A" to a "diagonally right-rear sound source", in accordance with direction information related to area sound collection.

Next, the area sound selection unit 6 selects area sounds to be used for reproduction, in accordance with the sound reproduction environment of the user side. That is, the area sounds to be used for reproduction are selected, in accordance with the sound condition environment, such as whether to reproduce stereophonic sound by headphones, earphones or the like or whether to reproduce stereophonic sound by stereo speakers at the user side, or whether to perform reproduction by a number of speakers at the time when reproducing by additional stereo speakers. Here, information related to the sound reproduction environment of the user side is set in advance, and the area sound selection unit 6 selects area sounds in accordance with the set sound reproduction environment. In addition, in the case where information related to the sound reproduction environment is set and changed, the area sound selection unit 6 may select area sounds, based on information of the sound reproduction environment after this change.

In the area volume adjustment unit 7, the volume of each of the area sounds is adjusted in accordance with a distance from the viewing and listening position (position of a target area). The volume reduces as the area becomes distant from the viewing and listening position. Or, the central area sound may be made the highest, and the surrounding area sounds may be reduced.

In the stereophonic sound processing unit 8, transfer function data retained in the transfer function data retention unit 10 is acquired, in accordance with the sound reproduction environment of the user side, and a stereophonic sound process of area sounds is applied and output by using this transfer function data.

Then, in the sound source speaker output unit 9, sound source data applied by the stereophonic sound process by the stereophonic sound processing unit 8 is output to each corresponding speaker array SA1 to SAn.

Hereinafter, the state of a reproduction process, which selects area sounds of a remote location and applies a stereophonic sound process, by the sound collection and reproduction system 100 according to an embodiment will be described.

FIG. 3A is figure viewed from overhead in which the space of a remote location has been divided into 9. A plurality of cameras which project area A to area I, and a plurality of microphone arrays MA1 to MAm able to collect each of the area sounds of area A to area I, are arranged in the space of the remote location.

For example, in the case where area E is selected as a viewing and listening position by a user, from among the plurality of areas of FIG. 3A, and the camera projects area E in a direction towards area E from area B, the area sound selection unit 6 sets the sound (area sound E) existing in area E which is the viewing and listening position to a sound source of the center (central sound source), sets area sound H to a "front sound source", sets area sound B to a "rear sound source", sets area sound D to a "right-side sound source" and sets area sound F to a "left-side sound source".

Afterwards, the stereophonic sound processing unit 8 selects the area sounds to be used for reproduction, in accordance with the sound reproduction environment of a user, and applies and outputs a stereophonic sound process to the selected area sounds.

For example, in the case where the sound reproduction environment of a user is a reproduction system of 2ch, the area sound selection unit 6 selects area sound E as a central sound source, area sound D as a right sound source, area sound F as a left sound source, and area sound area H as a front sound source. Further, a control is performed so that the volume of an area sound is gradually reduced as it separates from the center of the area E which is the viewing and listening position. In this case, the volume of the area sound H located more distant than the area E which is the viewing and listening position, for example, is weakly adjusted. Further, the sound collection and reproduction system creates a binaural sound source, in which a head-related transfer function (HRTF) corresponding to each direction is convoluted, for the sound sources selected as the area sounds to be used for reproduction.

More specifically, in the case where the sound reproduction environment of a user is a reproduction system such as headphones or earphones, a binaural sound source created by the sound collection and reproduction system is output as it is. However, in the case of a reproduction system such as the stereo speakers 51 and 52 of FIG. 3B, the characteristics of stereophonic sound will deteriorate when reproducing a binaural sound source as it is. For example, when the speaker 51 of the left side of FIG. 3B (the speaker located on the right side at the time when viewed from the user) reproduces a binaural sound source for the right ear, the characteristics of stereophonic sound will deteriorate due to crosstalk where the binaural sound source for the right ear output by the speaker 51 can also be heard in the left ear of the user. Accordingly, the sound collection and reproduction system 100 according to this embodiment measures an indoor transfer function between the user and each of the speakers 51 and 52 in advance, and designs a crosstalk canceller based on this indoor transfer function value. The crosstalk canceller can be applied to a binaural sound source, or conversion into a trans-aural sound source can be performed, and afterwards a stereophonic sound effect can be obtained the same as that of binaural reproduction by reproduction.

Further, for example in the case where the sound reproduction environment is a reproduction system of 3ch or more (for example, the case where speakers of 3ch or more are used), a stereophonic sound process is applied and reproduced for the area sounds to be used for reproduction, in accordance with the arrangement of the speakers. In addition, for example, in the case where the sound reproduction environment is a reproduction system of 4ch or more (for example, the case where 4 speakers are arranged with one each in front, behind, to the left and to the right of a user), area sound E is simultaneously reproduced from all of the speakers, and front, rear, left and right area sounds H, B, D and F are reproduced from speakers corresponding to each direction. In addition, area sound I and area sound G existing diagonally in front with respect to the area sound E, and area sound C and area sound A existing diagonally behind with respect to the area sound E, may be reproduced by converting to trans-aural sound sources. In this way, for example, since the area sound I is reproduced from the speakers located in front and to the left side of the user, the area sound I can be heard from between the front speaker and the left side speaker.

As described above, since the sound collection and reproduction system 100 according to this embodiment collects sounds for each area, the total number of sound sources existing in a space of a remote location will not be a problem. Further, since the position relationship of the sound collection areas is determined in advance, the direction of an area can be easily changed in accordance with the viewing and listening position of the user. In addition, the technique of area sound collection described in Patent Literature 1 proposed by the present inventors is capable of operating, in real-time, a system which reduces the calculation amount, even if a stereophonic sound process is added.

(A-4) The Effect of the Embodiment

According to an embodiment, such as the above described, a space of a remote location is divided into a plurality of areas, sounds are collected for each of the areas, a stereophonic sound process is performed for each of the area sounds, in accordance with a specified position by a user, and thereafter sounds are reproduced, and by additionally operating these processes in real-time, the present condition of various locations of the remote location can be experienced with an abundant presence.

(B) Another Embodiment

While various modified embodiments have been mentioned in the above described embodiments, an embodiment of the present disclosure is also capable of being applied to the following modified embodiment.

In the above described embodiment, while an illustration has been described in which an embodiment of the present disclosure is applied to a remote system which reproduces a stereophonic sound in cooperation with a camera video, by arranging a plurality of cameras and a plurality of microphone arrays in a space of a remote location, it is also possible to be applied to a system which reproduces a stereophonic sound of a remote location without coordinating with a camera video.

In the above described embodiments, while a case has been illustrated which uses microphone arrays which collect sounds of each of the areas with microphones arranged at the vertexes of a right-angled triangle, the microphones may be arranged at the vertexes of an equilateral triangle. The technique of area sound collection of this case can perform area sound collection by using the technique disclosed in Patent Literature 1.

The sound collection and reproduction system according to the above described embodiment may be implemented by dividing into a sound collection system (sound collection device) included at the remote location side, and a reproduction system (reproduction device) included at the user side, and the sound collection system and the reproduction system may be connected by a communication line. In this case, the sound collection system can include the microphone arrays MA1 to Mam, the data input unit 1, the space coordinate data retention unit 2, the microphone array selection unit 3 and the area sound collection unit 4 illustrated in FIG. 1. Further, the reproduction system can include the position and direction information acquisition unit 5, the area sound selection unit 6, the area volume adjustment unit 7, the stereophonic sound processing unit 8 and the transfer function data retention unit 10 illustrated in FIG. 1.

Note that the sound collection and reproduction method of the embodiments described above can be configured by software. In the case of configuring by software, the program that implements at least part of the sound collection and reproduction method may be stored in a non-transitory computer readable medium, such as a flexible disk or a CD-ROM, and may be loaded onto a computer and executed. The recording medium is not limited to a removable recording medium such as a magnetic disk or an optical disk, and may be a fixed recording medium such as a hard disk apparatus or a memory. In addition, the program that implements at least part of the sound collection and reproduction method may be distributed through a communication line (also including wireless communication) such as the Internet. Furthermore, the program may be encrypted or modulated or compressed, and the resulting program may be distributed through a wired or wireless line such as the Internet, or may be stored a non-transitory computer readable medium and distributed.

Heretofore, preferred embodiments of the present invention have been described in detail with reference to the appended drawings, but the present invention is not limited thereto. It should be understood by those skilled in the art that various changes and alterations may be made without departing from the spirit and scope of the appended claims.

What is claimed is:

1. A sound collection and reproduction system which reproduces a stereophonic sound by collecting area sounds of all areas divided within a space by using a plurality of microphone arrays arranged in the space, comprising:

a microphone array selection unit which selects a separate combination of microphones in the microphone arrays in the space for sound collection of each separate divided area within the space;

an area sound collection unit which collects sounds of each separate divided area by using the respective separate combination of microphones in the microphone arrays for each separate divided area selected by the microphone array selection unit;

an area sound selection unit which selects an area sound of a first separate divided area corresponding to a specified listening position, and area sounds of surrounding separate divided areas, surrounding the first separate divided area and corresponding to a listening direction, from among area sounds of all the separate divided areas to which sound collection has been performed by the area sound collection unit, in accordance with a sound reproduction environment;

an area volume adjustment unit which adjusts a volume of sound of each of the separate divided areas selected by the area sound selection unit in accordance with a distance from the specified listening position; and a stereophonic sound processing unit which performs a stereophonic sound process, for each area sound to which volume adjustment has been performed by the area volume adjustment unit, by using a transfer function corresponding to the sound reproduction environment.

2. The sound collection and reproduction system according to claim 1, wherein the area sound collection unit includes:

a directivity forming unit which forms a directivity for output signals of each of the microphone arrays in a sound collection area direction by a beam former;

a delay correction unit which corrects a propagation delay amount, in output signals of each of the microphone arrays after the beam former, so that area sounds from each of the areas arrive simultaneously at all microphone arrays used for sound collection of these areas;

an area sound power correction coefficient calculation unit which calculates a ratio of an amplitude spectrum for each frequency between the beam former output signals of each of the microphone arrays, and calculates a correction coefficient based on frequencies of the ratios; and an area sound extraction unit which extracts noise existing in a sound collection area direction by spectrally subtracting the beam format output signals of each of the microphone arrays corrected by using the correction coefficient calculated by the area sound power correction coefficient calculation unit, and extracts area sounds by spectrally subtracting this extracted noise from the beam format output signals of each of the microphone arrays.

3. The sound collection system of claim 1, wherein each microphone array comprises two or more microphones located closer to each other than to any microphone of any other microphone array among the plurality of microphone arrays, and the microphone array selection unit selects at least one microphone from a first array and at least one microphone from a second array for sound collection of a first divided area in the space.

4. A sound collection and reproduction apparatus which reproduces a stereophonic sound by collecting area sounds of all areas divided within by a space by using a plurality of microphone arrays arranged in the space, comprising:

a microphone array selection unit which selects a separate combination of microphones in the microphone arrays in the space for sound collection of each separate divided area within the space;

an area sound collection unit which collects sounds of each separate divided area by using the respective separate combination of microphones in the microphone arrays for each separate divided area selected by the microphone array selection unit;

an area sound selection unit which selects an area sound of a first separate divided area corresponding to a specified listening position, and area sounds of surrounding separate divided areas, surrounding the first separate divided area and corresponding to a listening direction, from among area sounds of all the separate divided areas to which sound collection has been performed by the area sound collection unit, in accordance with a sound reproduction environment;

an area volume adjustment unit which adjusts a volume of each area sound selected by the area sound selection unit in accordance with a distance from the specified listening position; and a stereophonic sound processing unit which performs a stereophonic sound process, for each area sound to which volume adjustment has been performed by the area volume adjustment unit, by using a transfer function corresponding to the sound reproduction environment.

5. A sound collection and reproduction method which reproduces a stereophonic sound by collecting area sounds of all areas divided within a space by using a plurality of microphone arrays arranged in the space, comprising:

selecting, by a microphone array selection unit, a separate combination of microphones in the microphone arrays in the space for sound collection of each separate divided area within the space;

collecting by an area sound collection unit, sounds of each separate divided area by using the respective separate combination of microphones in the microphone arrays for each separate divided area selected by the microphone array selection unit;

selecting, by an area sound selection unit, an area sound of a first separate divided area corresponding to a specified listening position, and area sounds of surrounding separate divided areas, surrounding the first separate divided area and corresponding to a listening direction, from among area sounds of all the separate divided areas to which sound collection has been performed by the area sound collection unit, in accordance with a sound reproduction environment;

adjusting, by an area volume adjustment unit, a volume of each area sound selected by the area sound selection unit in accordance with a distance from the specified listening position; and performing, by a stereophonic sound processing unit, a stereophonic sound process, for each area sound to which volume adjustment has been performed by the area volume adjustment unit, by using a transfer function corresponding to the sound reproduction environment.

6. A non-transitory computer-readable recording medium in which a sound collection and reproduction program is stored, the sound collection and reproduction program reproducing a stereophonic sound by collecting area sounds of all areas divided within a space by using a plurality of microphone arrays arranged in the space, and the sound collection and reproduction program causing a computer to function as:

a microphone array selection unit which selects a separate combination of microphones in the microphone arrays in the space for sound collection of each separate divided area within the space;

an area sound collection unit which collects sounds of each separate divided area by using the respective separate combination of microphones in the microphone arrays for each separate divided area selected by the microphone array selection unit;

an area sound selection unit which selects an area sound of a first separate divided area corresponding to a specified listening position, and area sounds of surrounding separate divided areas, surrounding the first separate divided area and corresponding to a listening direction, from among area sounds of all the areas to which sound collection has been performed by the area sound collection unit, in accordance with a sound reproduction environment;

an area volume adjustment unit which adjusts a volume of each area sound selected by the area sound selection unit in accordance with a distance from the specified listening position; and a stereophonic sound processing unit which performs a stereophonic sound process, for each area sound to which volume adjustment has been performed by the area volume adjustment unit, by using a transfer function corresponding to the sound reproduction environment.

7. A sound collection system which collects area sounds of all areas divided within a space by using a plurality of microphone arrays arranged in the space, comprising:

a microphone array selection unit which selects a separate combination of microphones in the microphone arrays within the space for sound collection of each separate divided area within the space; and an area sound collection unit which collects sounds of each separate divided area by using the respective separate combination of microphones in the microphone arrays for each separate divided area selected by the microphone array selection unit, wherein each microphone array comprises two or more microphones located closer to each other than to any microphone of any other microphone array among the plurality of microphone arrays, and the microphone array selection unit selects at least one microphone from a first array and at least one microphone from a second array for sound collection of a first divided area in the space.

8. A reproduction system which reproduces a stereophonic sound by collecting area sounds of all areas divided within a space by using a plurality of microphone arrays arranged in the space, comprising:

an area sound selection unit which selects an area sound of a first divided area corresponding to a specified listening position, and area sounds of surrounding separate divided areas, surrounding the first divided area and corresponding to a listening direction, from among area sounds of all the separate divided areas, in accordance with a sound reproduction environment;

an area volume adjustment unit which adjusts a volume of each area sound selected by the area sound selection unit in accordance with a distance from the specified listening position; and a stereophonic sound processing unit which performs a stereophonic sound process, for each area sound to which volume adjustment has been performed by the area volume adjustment unit, by using a transfer function corresponding to the sound reproduction environment, wherein each microphone array comprises two or more microphones located closer to each other than to any microphone of any other microphone array among the plurality of microphone arrays, and the microphone array selection unit selects at least one microphone from a first array and at least one microphone from a second array for sound collection of a first divided area in the space.

* * * * *